US006964089B2

(12) United States Patent
Ramirez

(10) Patent No.: US 6,964,089 B2
(45) Date of Patent: Nov. 15, 2005

(54) SINK FLANGE ASSEMBLY INSTALLATION METHOD AND TOOL

(76) Inventor: Albert F. Ramirez, 8920 Limonite Ave. #167, Riverside, CA (US) 92509

( * ) Notice: Subject to any disclaimer, the term of this patent is extended or adjusted under 35 U.S.C. 154(b) by 230 days.

(21) Appl. No.: 10/448,166

(22) Filed: May 29, 2003

(65) Prior Publication Data

US 2003/0192162 A1 Oct. 16, 2003

Related U.S. Application Data

(63) Continuation-in-part of application No. 09/961,851, filed on Sep. 24, 2001, now Pat. No. 6,615,474.

(60) Provisional application No. 60/281,084, filed on Apr. 2, 2001.

(51) Int. Cl.[7] ..... B23P 11/02; B25B 7/02
(52) U.S. Cl. ..... 29/450; 29/229; 29/268
(58) Field of Search ..... 29/450, 451, 235, 29/229, 225, 268

(56) References Cited

U.S. PATENT DOCUMENTS

| | | | | |
|---|---|---|---|---|
| 366,436 | A * | 7/1887 | Sylvester | 411/90 |
| 387,226 | A | 8/1888 | Gleich et al. | |
| 1,219,160 | A | 3/1917 | Rosenblatt | |
| 2,254,030 | A * | 8/1941 | Fall | 92/195 |
| 2,483,380 | A * | 9/1949 | Duffy | 29/229 |
| 2,716,273 | A | 8/1955 | Woodruff et al. | |
| 3,050,841 | A | 8/1962 | Esselstyn | |
| 3,169,307 | A * | 2/1965 | Langwell | 29/229 |
| 3,619,890 | A | 11/1971 | Kubokawa | |
| 4,106,374 | A | 8/1978 | Dragan | |
| 4,907,477 | A | 3/1990 | Farber | |
| 5,023,989 | A | 6/1991 | Hargrave | |
| 5,212,859 | A | 5/1993 | Hagarty | |
| 5,311,798 | A | 5/1994 | Trusky | |
| 5,515,587 | A | 5/1996 | Pool | |
| 5,584,110 | A | 12/1996 | Mordoch | |
| 5,833,290 | A | 11/1998 | Curelop et al. | |
| 6,145,417 | A | 11/2000 | Bates et al. | |
| 6,189,190 | B1 * | 2/2001 | Gillet et al. | 29/229 |
| 6,360,419 | B1 | 3/2002 | Newcomer | |
| 6,477,756 | B2 | 11/2002 | Newcomer | |
| 6,615,474 | B2 * | 9/2003 | Ramirez | 29/450 |

OTHER PUBLICATIONS

Installation Instructions for In Sink Erator food waste disposer; Emerson Electric Co. Of Racine, Wisconsin; published more than one year prior to the filing date of the priority application.

* cited by examiner

*Primary Examiner*—David P. Bryant
(74) *Attorney, Agent, or Firm*—Kirk A. Buhler; Buhler & Associates

(57) ABSTRACT

A tool for installing a locking ring in an annular groove defined by a lower annular rim portion of a sink flange of a garbage disposer sink flange assembly. The tool includes a pair of elongated members that are pivotally connected at a pivot point to form a pair of opposed handles and a pair of opposed ring-engaging tips. The tips define a pair of outwardly facing indentations that adapt the tips to engaging the locking ring in order to spread the locking ring by operation of the person squeezing the handles toward each other. Mechanical stops are located in the opposing handles that prevent excessive spreading of the locking ring. In addition, the tool is configured such that when the tool is brought into position, and the tool is leaned over the locking ring is released from the ring-engaging tips.

8 Claims, 4 Drawing Sheets

SINK FLANGE ASSEMBLY INSTALLATION METHOD AND TOOL

This application is a continuation in part (CIP) and claims the benefit of U.S. Utility application Ser. No. 09/961,851 filed Sep. 24, 2001 now U.S. Pat. No. 6,615,474 which claims the benefit of U.S. Provisional Application Ser. No. 60/281,084 filed Apr. 2, 2001.

FIELD OF THE INVENTION

This invention relates generally to home construction equipment and tools, and more particularly to a method and tool for installing a sink flange assembly of the type having a locking ring component that fits in an annular groove on a sink flange component (e.g., a typical garbage disposer sink flange assembly).

BACKGROUND OF THE INVENTION

The term "garbage disposer sink flange assembly" refers to an assembly that fits in the drain hole of a sink for use in mounting a food waste disposer unit (i.e., a garbage disposer) just beneath the sink. Regardless of the particular type and kind, the garbage disposer sink flange assembly serves as means to provide a watertight mounting on the sink for the garbage disposer. Installation requires some skill as the installer operates above and under the sink to install the sink flange. As he does so, certain problems arise.

To visualize some of the problems, consider the installation of a typical commercially available sink flange assembly that includes a sink flange, a fiber gasket, a backup ring, a mounting ring, and a snap ring (i.e., a locking ring). In compliance with the installation instructions supplied with the sink flange assembly, the installer first works above the sink to apply plumber's putty on the upper side of the sink around the drain hole. Next, he inserts the sink flange into the sink hole, pressing down on it slowly and firmly so that it seats evenly on the plumber's putty. Then, he moves to a position beneath the sink to mount the other components on the lower portion of the sink flange extending through the sink hole.

From his position beneath the sink, he positions the fiber gasket on the lower portion of the sink flange, followed by the backup ring and then the mounting ring. Holding those components tightly against the underside of the sink, he slides the locking ring onto the lower portion of the sink flange until the locking ring pops or snaps into an annular groove defined by the lower portion of the sink flange. Once that is accomplished, he tightens three screws on the mounting ring that bear upwardly against the backup ring. That forces the mounting ring downwardly against the locking ring, and that pulls the sink flange down tightly against the plumber's putty on the upper side of the sink.

In doing this, various problems arise. First, the sink flange tends to move upwardly when any upward pressure is applied to it, and that dislodges the sink flange from its seated position on the plumber's putty. To overcome that problem, another person can help from a position above the sink by pressing downwardly on the sink flange while the installer completes the installation beneath the sink. Alternatively, as the instructions provide, a weighted object can be placed in the sink atop the sink flange to hold the sink flange in place, using a towel under the object to prevent scratching of the sink. Either way involves more time and effort.

One commonly used method of installing the locking ring uses screwdrivers to wedge against and spread the locking ring while pushing upwardly. Many missed attempts often result, jarring the sink flange all the more. Another method of installing the locking ring attempts to spread the locking ring by hand while pushing it upwardly, risking finger and thumb cuts on the sharp edge of the sink flange. In other words, existing procedures are time consuming and frustrating and they risk injury. These methods also present the hazard of the backup ring and the mounting ring falling down on the installer's face or head while he is working below the sink. Thus, a need exists for a better way to install a sink flange assembly.

SUMMARY OF THE INVENTION

This invention addresses the concerns outlined above by providing a facilitating method and tool for installing a locking ring on the sink flange component of a sink flange assembly. The tool is used to engage the locking ring, to spread the locking ring, and to place the locking ring in the groove without disrupting the sink flange seating. Doing so according to the present invention avoids the need for two people or for a heavy weight on the sink flange. Installation proceeds quickly and efficiently without lost time, and it avoids injury to the fingers and thumb of the installer.

To paraphrase some of the more precise language appearing in the claims, a method for installing a locking ring in an annular groove defined by a lower annular rim portion of a sink flange includes the step of providing a ring-engaging-and-expanding tool. The tool has a pair of opposed first and second handles and a pair of opposed ring-engaging first and second tips such that the first and second tips are adapted to engage the locking ring in order to spread the locking ring by operation of the person squeezing the first and second handles toward each other. The first and second tips are also adapted to engage the annular rim portion of the sink flange, and the tool is designed to dislodge the locking ring without requiring two hands. The temporary holding mechanism of the tool is designed to allow the installer to lean over, tilt, tip, swayed, rotate or rock the tool to release the locking ring from the tool. Various words of motion are used here to describe the action the user will perform with the tool that will result in wedging the locking ring off the temporary holding mechanism. The method proceeds by (i) engaging and spreading the locking ring with the first and second tips of the tool by squeezing the handles toward each other (ii) moving the tool to a position such that the locking ring circumscribes (i.e., surrounds) the groove and the first and second tips engage the lower rim portion of the sink flange; and (iii) rotating or rocking the tool to complete placement of the locking ring in the groove.

In line with the foregoing method, a tool constructed according to the invention for installing a locking ring in an annular groove defined by a lower annular rim portion of a sink flange (e.g., a sink flange component of a garbage disposer sink flange assembly) includes a pair of first and second elongated members that are pivotally connected to each other at a pivot point to form a pair of opposed first and second handles and a pair of opposed ring-engaging first and second tips. The first and second tips move away from each other by operation of a person squeezing the first and second handles toward each other. Each of the first and second tips defines a respective one of a pair of outwardly facing first and second indentations that adapt the first and second tips to function as means for engaging the locking ring in order to spread the locking ring by operation of the person squeezing the first and second handles toward each other. Each of the first and second tips also defines a respective one of a pair of inwardly facing third and fourth indentations that adapt the first and second tips to function as means for engaging the annular rim portion of the sink flange. In addition, each of the first and second elongated members includes a respective one of a pair of first and second ring-dislodging structure in the form of edges that function as means for enabling the person to dislodge the locking ring from the first and second tips in order to complete installation of the locking ring in the annular groove.

Thus, the invention provides a sink flange assembly installation method and tool that significantly facilitate installation. The following illustrative drawings and detailed description make the foregoing and other objects, features, and advantages of the invention more apparent.

DETAILED DESCRIPTION

Figure 1:
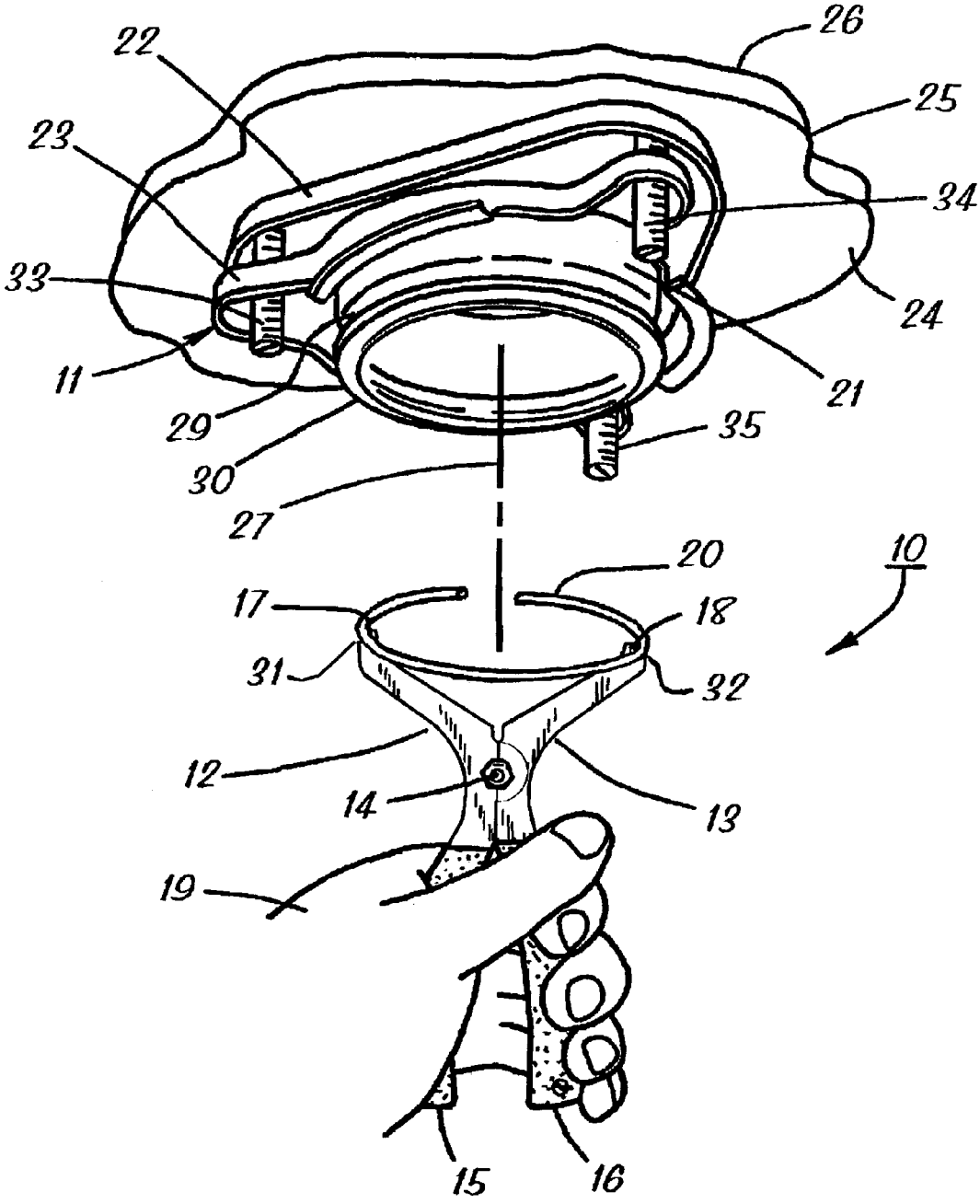
FIG. 1 of the drawings is an isometric view of a tool constructed according to the invention, shown in use by an installer as the tool engages and expands a locking ring in order to facilitate installation of the expanded locking ring on an existing sink flange assembly.

FIGS. 1–5 of the drawings show various aspects of a method and tool 10 for installing a garbage disposer sink flange assembly 11 according to the invention. Generally, a tool constructed according to the invention includes a pair of first and second elongated members that are pivotally connected to each other at a pivot point to form a pair of opposed first and second handles and a pair of opposed ring-engaging first and second tips such that the first and second tips move away from each other by operation of a person squeezing the first and second handles toward each other. Thus, the tool 10 includes a pair of first and second elongated members 12 and 13 (FIGS. 1 and 3) that are pivotally connected to each other at a pivot point 14 (i.e., a pivotal axis that is generally perpendicular to the page on which FIG. 3 appears) to form a pair of opposed first and second handles 15 and 16 (the proximal end portions of the elongated members), and a pair of opposed ring-engaging first and second tips 17 and 18 (the distal end portions of the elongated members).

The elongated members 12 and 13 are fabricated from a suitably strong rigid material in the preferred embodiment the material is 1/16 inch thick steel, but could also be made from a rigid non-metallic material such as plastic, and they are connected together pivotally so that the first and second tips 17 and 18 move away from each other by operation of a person 19 (FIG. 1) squeezing the first and second handles 15 and 16 sufficiently to cause them to move toward each other. The person 19 does that to engage and spread a locking ring 20 for purposes of installing the locking ring 20 with other components of a garbage disposer sink flange assembly 11 shown in FIG. 1.

The sink flange assembly 11 represents any of various types and kinds of sink flange assemblies. It includes a sink flange 21 (e.g., a metal component having a 3.375-inch outside diameter), a backup ring 22, a mounting ring 23, and the locking ring 20 (e.g., 0.125-inch diameter spring steel wire forming a 3.25-inch diameter inside diameter ring when not 20 expanded). The sink flange assembly 11 usually includes a gasket also for mounting between the backup ring 22 and an underside 24 of a sink 25 (FIGS. 1 and 2), but that component is not really necessary for an understanding of the present invention and so a gasket has not been illustrated.

With the sink flange 21 extending downwardly from an upper side 26 of the sink 25, along a vertically extending central axis of symmetry 27 of the sink flange 21, and through a sink drain hole 28 (FIG. 2) in the sink 25, the person 19 places the backup ring 22 and the mounting ring 23 over the sink flange 21 to partially assemble those components (FIG. 1). Next, he uses a ring-engaging-and-expanding tool (e.g., the tool 10) to place the locking ring 20 in an annular groove 29 defined by a lower annular rim portion 30 of the sink flange 21. The tool 10 is shown expanding the locking ring 20 in FIG. 1 by operation of the person 19 squeezing the handles 15 and 16 toward each other. He expands the diameter of the locking ring 20 sufficiently to fit over the lower annular rim portion 30. After placing the locking ring 20 in the annular groove 29, the person 19 leans over the tool that allows the edges on the flat portion of the tool at items 31 and 32, of the tool 10 to dislodge the locking ring 20 from the first and second tips 17 and 18. The motion of leaning the tool over involves pivoting the tool about the point where the edge 41 of the tool makes contact with the mounting ring 20 until the ring is released. The amount of leaning may be as small as a few degrees to as much as 90 degrees until the rings dislodges from the hand tool. The installer then tightens three screws 33, 34, and 35 on the mounting ring 23 to complete the installation.

Figure 2:
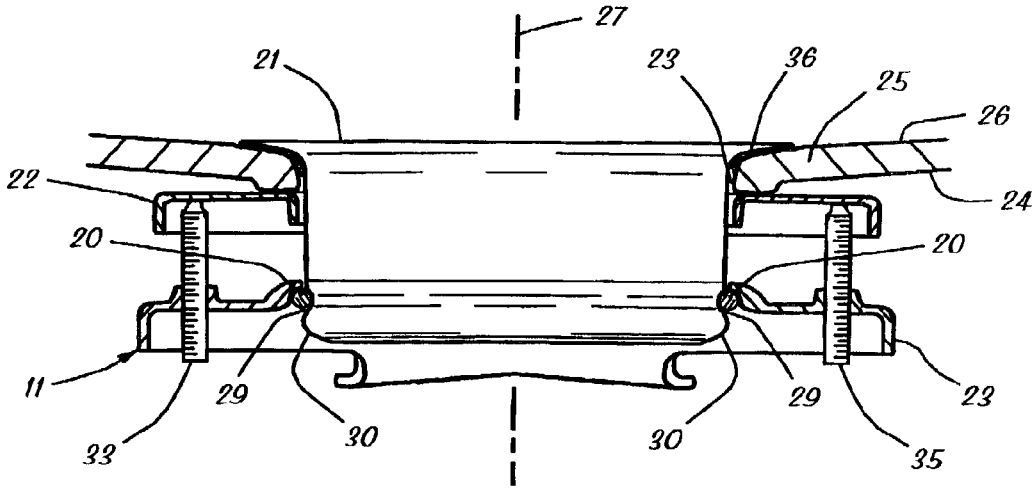
FIG. 2 is an enlarged cross section view of the installed sink flange assembly as viewed in a vertical plane containing the central axis of symmetry of the assembly, showing the completed assembly after placement of the locking ring and tightening of the screws on the mounting ring against the backup ring.

The use of a ring-engaging-and-expanding tool significantly facilitates installation without disrupting the sink flange 21 seating on the plumber's putty that is identified by reference numeral 36 in FIG. 2. The use of a ring-engaging-and-expanding tool avoids the need for two people or for a heavy weight on the sink flange 21. Installation proceeds quickly and efficiently without lost time while avoiding injury to the fingers and thumb of the person 19 and controlling the backup ring 22 and the mounting ring 23 from falling down on the person 19 or other installer.

Figure 3:
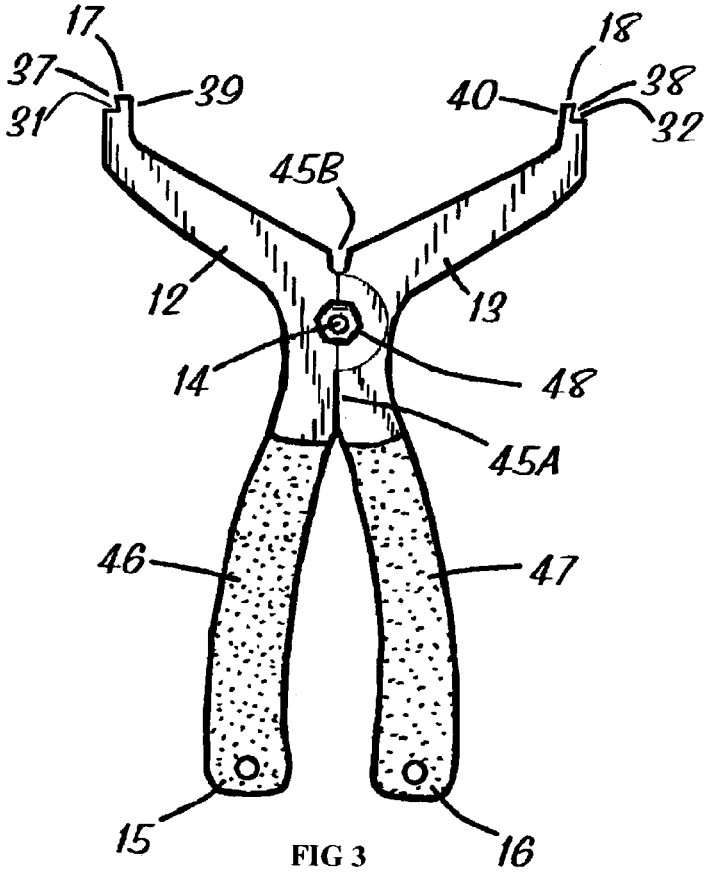
FIG. 3 is a plan view of just the ring-engaging-and-expanding tool.

FIG. 3 focus more on the tool 10. The first and second elongated members 12 and 13 and their first and second tips 17 and 18 are generally similar for reduced fabrication costs, the second one being flipped horizontally with respect to the first one (i.e., rotated 180 degrees about an axis of elongation) before being connected to the first one at the pivot point 14. Inasmuch as they are so similar, only the tip 18, locking ring 20 and a portion of the annular groove 29 are illustrated in FIGS. 4A–4D. Each one of the first and second tips of a tool constructed according to the invention defines a respective one of a pair of outwardly facing first and second indentations that adapt the first and second tips to function as means for engaging the locking ring in order to spread the locking ring by operation of the person squeezing the first and second handles toward each other. Accordingly, each one of the first and second tips 17 and 18 defines a respective one of a pair of outwardly facing first and second indentations 37 and 38. They face radially outward with respect to the central axis of symmetry 27 in FIG. 1 when the tool is positioned as shown in FIG. 1, with the central axis of symmetry 27 passing through the pivot point 14 and thereby through the center of the locking ring 20 (not identified by a reference numeral). That adapts the first and second tips 17 and 18 to function as means for engaging the locking ring 20 in order to hold and spread the locking ring 20 by operation of the person 19 or other installer squeezing the first and second handles 15 and 16 toward each other. They adapt the first and second tips 17 and 18 to that function in the sense that the first and second indentations 37 and 38 are sized to receive the cross sectional shape (e.g., circular) of the locking ring 20, as illustrated in FIGS. 4A–4D for the second indentation 38, in order to thereby impede movement of the locking ring 20 relative to the first and second tips 17 and 18 during movement of the tool 10 and the locking ring 20 to the position in which the locking ring 20 surrounds the annular groove 29.

Each one of the first and second tips of a tool constructed according to the invention also defines a respective one of a pair of inwardly facing third and fourth indentations that adapt the first and second tips to function as means for engaging the annular rim portion of the sink flange. Accordingly, each one of the first and second tips 17 and 18 also defines a respective one of a pair of inwardly facing third and fourth indentations 39 and 40 (FIG. 3). The third and fourth indentations 39 and 40 face radially inward with respect to the central axis of symmetry 27 in FIG. 1 when the tool is positioned as shown in FIG. 1. That adapts the first and second tips 17 and 18 to function as means for engaging the lower annular rim portion 30 of the sink flange 21.

The first and second tips 17 and 18 engage the lower annular rim portion 30 when the person 19 releases his squeeze on the handles 15 and 16 slightly. When he does that, the spring biasing action provided to the first and second elongated members 17 and 18 by the resiliently deformable locking ring 20 moves the tips 17 and 18 radially inward into engagement with the lower annular rim portion 30. In other words, the third and fourth indentations 39 and 40 adapt the first and second tips 17 and 18 to the stated function in the sense that the third and fourth indentations 39 and 40 are sized to receive the cross sectional shape of the lower annular rim portion 30 of the sink flange 21 in order to thereby impede movement of the first and second tips 17 and 18 of the tool 10 (and the locking ring 20) relative to the lower annular rim portion 30.

Figure 4A:
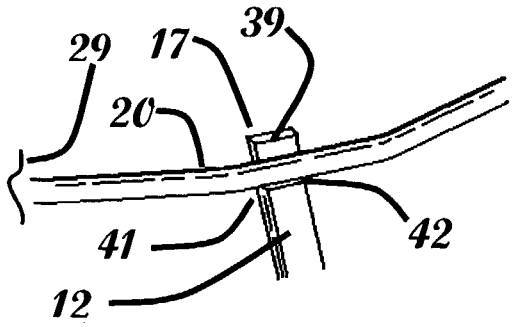
FIGS. 4A–4D is a series of enlarged views showing the locking ring initially seat on the tool and the tool being tipped and the ring being dislodged onto the sink flange.

In addition, each one of the first and second elongated members of a tool constructed according to the invention includes a respective one of a pair of first and second ring-dislodging edges 41 and 42 located on the flat portion shown in FIG. 4A on one side of the tool at 31, that are adapted to function as means for enabling the person to dislodge the locking ring from the first and second tips 17 and 18 in order to complete installation of the locking ring 20 in the annular groove 29.

Figure 4B:
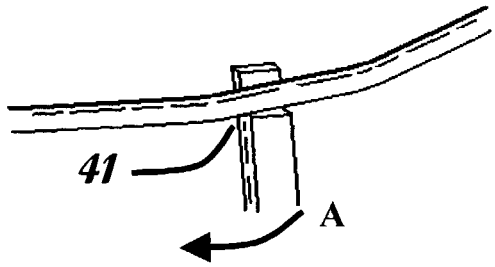
Figure 4C:
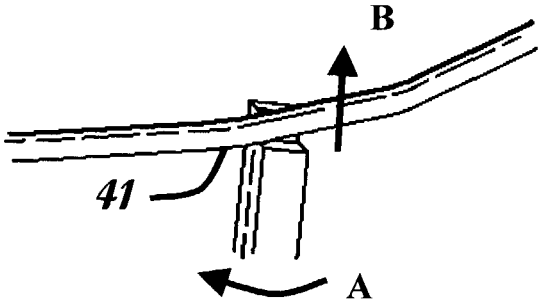
Figure 4D:
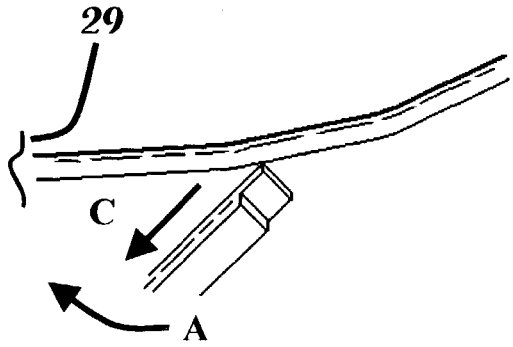

To dislodge the locking ring 20, the person 19 leans over the tool such that either of the first or second edges 41 and 42, as depicted by edge 41 and the rotation of the tool shown by arrow A in FIG. 4B, that causes them to pry the locking ring 20 upwardly out of the first and second indentations 31 and 32. Once wedged upwardly out of the indentations 31 and 32, the locking ring 20 springs back toward its unexpanded size as depicted by arrow B in FIG. 4C to thereby seat in the annular groove 29 as shown in FIG. 4C. The locking ring 20 snaps in place in the groove 29 and the person 19 withdraws the tool 10 downwardly as depicted by an arrow C in FIG. 4D.

As a further idea of size, the tool 10 measures about 5.75 inches long, with the first and second indentations 37 and 38 being spaced apart about 3.75 inches when the first and second handles 15 and 16 are squeezed together to the position illustrated in FIG. 3. First and second stop components 45A and 45B on the second elongated member 18 (FIG. 3) limit how far the first and second handles 15 and 16 can be moved toward and away from each other (i.e., the range of motion of the tool 10). The stop component functions as means for limiting the amount the person 19 can squeeze the first and second handles 15 and 16 toward each other. In the preferred embodiment the limiting mechanism is formed or integrated from or into the handles. In addition to the foregoing, the first and second handles 15 and 16 include flexible rubber coatings 46 and 47 for better gripping. A nut-and-bolt combination 48 or other suitable fastener connects the first and second elongated members together at the pivot point 14 (FIG. 3). The fastener may also be a rivet that swages the two halves of the tool together.

Thus, the tool 10 is adapted to work with the locking ring 20 of the sink flange assembly 11 for purposes of facilitating the installation of the locking ring 20. Recapitulating the methodology employed, a method for installing a locking ring (e.g., the locking ring 20) in an annular groove defined by a lower annular rim portion of a sink flange (e.g., the groove 29 in the sink flange 21) includes the step of providing a ring-engaging-and-expanding tool as described above (e.g., the tool 10). The method proceeds as illustrated by engaging and spreading the locking ring 20 with the first and second tips 17 and 18 of the tool 10 as depicted in FIG. 1. Next, the person 19 moves the tool 10 to a position such that the locking ring 20 surrounds the groove 29 and the first and second tips 17 and 18 engage the lower rim portion 30 of the sink flange 21 as depicted in FIG. 1. Then, the person 19 leans the tool over allowing the edges of the tool 31 and 32 to dislodge the locking ring 20 from the tips 17 and 18 as depicted in FIG. 4 to complete placement of the locking ring 20 in the groove 29. After that, the person 19 tightens the screws 33–35 so that the mounting ring 23 bears downwardly against the locking ring 20. That action applies downward force to the locking ring 20 and the sink flange 21 in order to secure the sink flange 21 downwardly against the plumber's putty 36 on the upper side 26 of the sink 25 (FIG. 2).

Figure 5:
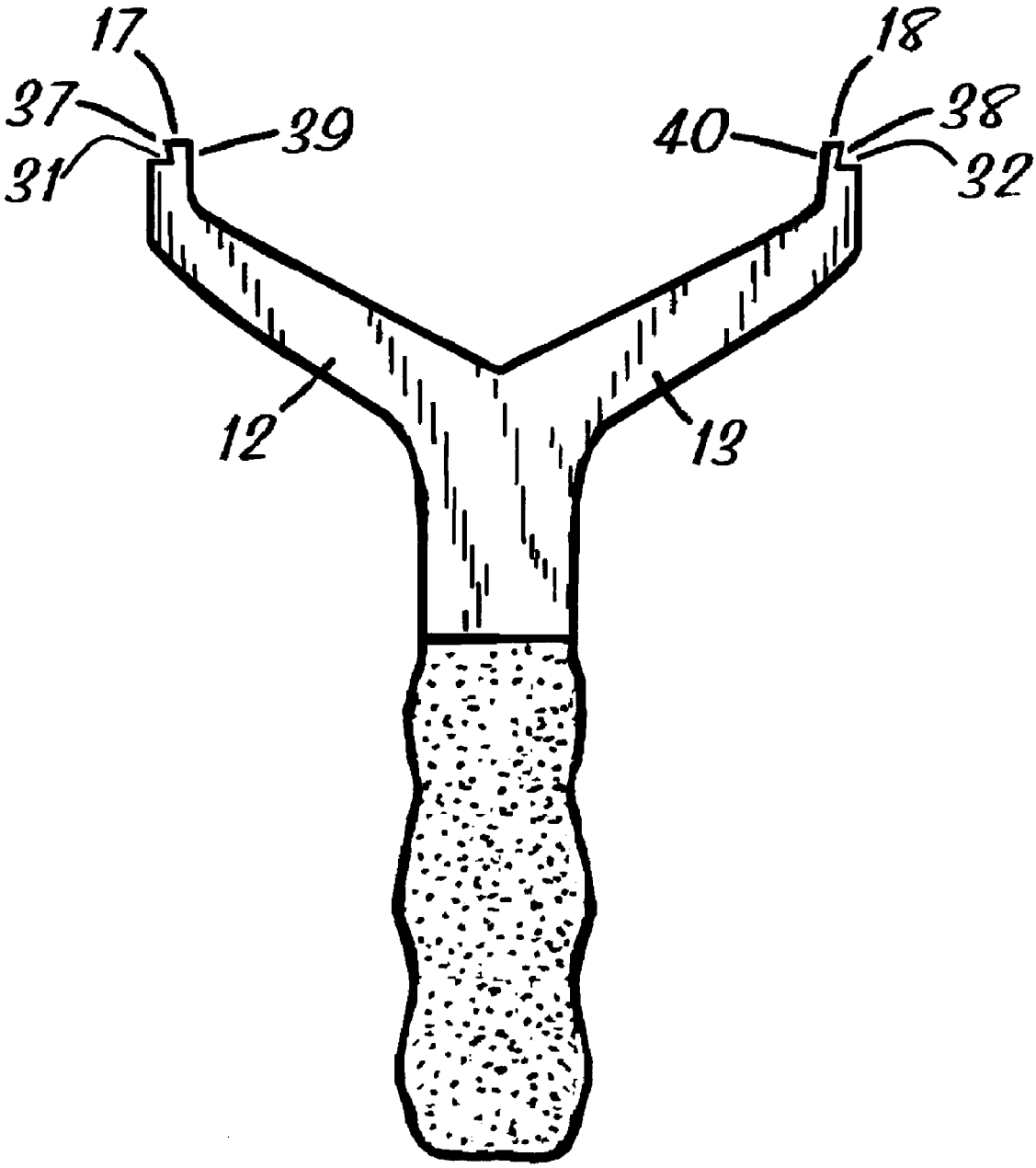
FIG. 5 is a plan view of a one-piece design of the tool.

In another embodiment the tool may be fabricated from a single metal or plastic part as shown in FIG. 5, where the person 19 manually expands the ring 20, and places the expanded ring onto the outwardly facing tips 17 and 18 of the tool. The person then lifts the tool into position where the inward facing indentations 39 and 40 against the lower annular rim portion of the sink 29. The person then leans over the tool to release the ring into the annular grove 29 in a method similar to previously described and shown in FIG. 4.

The foregoing makes it apparent that the method and tool of the invention significantly facilitate locking ring installation without disrupting the sink flange. The use of a ring-engaging-and-expanding tool avoids the need for two people or for a heavy weight on the sink flange. Installation proceeds quickly and efficiently without lost time while avoiding injury to the fingers and thumb of the person 19 or other installer. Although exemplary procedures and an exemplary embodiment have been shown and described, one of ordinary skill in the art may make many changes, modifications, and substitutions without necessarily departing from the spirit and scope of the invention.

What is claimed is:

1. A method for installing a locking ring in an annular groove defined by a lower annular rim portion of a sink flange, the method comprising:

providing a tool having a pair of opposed first and second handles, a pair of opposed ring-engaging first and second tips such that the first and second tips are adapted to engage the locking ring in order to spread the locking ring by squeezing the first and second handles toward each other, the first and second tips being adapted to engage the annular rim portion of the sink flange, and the tips that engage the locking ring include edges that allow the locking ring to dislodge when the tool is leaned over to complete placement of the locking ring in the groove;

engaging and spreading the locking ring with the first and second tips of the tool by squeezing the handles toward each other;

moving the tool to a position such that the spread locking ring circumscribes the groove and the first and second tips engage the lower rim of the sink flange; and leaning the tool with respect to the locking ring to dislodge the locking ring from the tool and position the locking ring within the groove.

2. The method of claim 1, wherein the tool allows the locking ring to be installed with the use of one hand.

3. A tool for installing a locking ring in an annular groove defined by a lower annular rim portion of a sink flange, the tool comprising:

a pair of elongated members that are pivotally connected to each other to form a pair of opposed handles;

an outwardly facing indentation at a distal portion of each handle that functions to engage the locking ring;

an inwardly facing indentation at a distal portion of each handle that functions to engage the sink flange;

wherein when the locking ring is engaged by the outwardly facing indentations and the handles are squeezed toward each other the locking ring is spread; and the outwardly facing indentations further include ring-dislodging structure that allows the tool to dislodge the locking ring from the tool when the tool is leaned with respect to the locking ring.

4. The tool as recited in claim 3, wherein the elongated members have a similar shape, one member being flipped and connected to the other member at the pivot point to form the tool.

5. The tool as recited in claim 3, wherein the elongated members include means for limiting the amount the first and second handles can be squeezed toward each other.

6. The tool as recited in claim 3, wherein the elongated members includes means for limiting the amount the distal portions of the elongated handles close toward each other.

7. The tool as recited in claim 3, wherein the first and second handles include a coating.

8. The tool as recited in claim 7, wherein the coating is made from a flexible material.

* * * * *